US010932499B2

(12) United States Patent
Qiu

(10) Patent No.: US 10,932,499 B2
(45) Date of Patent: Mar. 2, 2021

(54) ELECTRONIC CIGARETTE BATTERY ASSEMBLY, ELECTRONIC CIGARETTE THEREWITH, AND CONTROL METHOD OF THE ELECTRONIC CIGARETTE

(71) Applicant: JOYETECH EUROPE HOLDING GMBH, Zug (CH)

(72) Inventor: Wei-Hua Qiu, ChangZhou (CN)

(73) Assignee: JOYETECH EUROPE HOLDING GMBH, Zug (CH)

( * ) Notice: Subject to any disclaimer, the term of this patent is extended or adjusted under 35 U.S.C. 154(b) by 382 days.

(21) Appl. No.: 16/003,118

(22) Filed: Jun. 8, 2018

(65) Prior Publication Data

US 2018/0289070 A1 Oct. 11, 2018

Related U.S. Application Data

(63) Continuation-in-part of application No. PCT/CN2016/098439, filed on Sep. 8, 2016.

(30) Foreign Application Priority Data

Dec. 9, 2015 (CN) ..... 201510903949.7

(51) Int. Cl.
*A24F 47/00* (2020.01)

(52) U.S. Cl.
CPC ..... *A24F 47/008* (2013.01)

(58) Field of Classification Search
CPC ..... A24F 47/008
See application file for complete search history.

(56) References Cited

U.S. PATENT DOCUMENTS

| | | | | |
|---|---|---|---|---|
| 2011/0115547 | A1 | 5/2011 | Wang | |
| 2011/0242029 | A1 | 10/2011 | Kasahara et al. | |
| 2015/0181945 | A1* | 7/2015 | Tremblay | A24F 47/008 131/328 |
| 2016/0143361 | A1* | 5/2016 | Juster | H05B 1/0244 392/404 |

FOREIGN PATENT DOCUMENTS

| | | | |
|---|---|---|---|
| CN | 101699369 | A | 4/2010 |
| CN | 102214038 | A | 10/2011 |
| CN | 202800121 | U | 3/2013 |
| CN | 202890465 | U | 4/2013 |
| CN | 203482902 | U | 3/2014 |
| CN | 104898926 | A | 9/2015 |

* cited by examiner

*Primary Examiner* — Eric Yaary
(74) *Attorney, Agent, or Firm* — ScienBiziP, P.C.

(57) ABSTRACT

An electronic cigarette battery assembly of an electronic cigarette includes a pressure sensor converting pressure information when a pressure is applied to the electronic cigarette battery assembly into sensed data, an information storage for storing preset values; and a controller for comparing the sensed data with the preset values and for controlling operating states of an atomizer based on comparison results of sensed data and preset values.

18 Claims, 6 Drawing Sheets

ELECTRONIC CIGARETTE BATTERY ASSEMBLY, ELECTRONIC CIGARETTE THEREWITH, AND CONTROL METHOD OF THE ELECTRONIC CIGARETTE

CROSS-REFERENCE TO RELATED APPLICATIONS

This application claims priority to CN Patent Application, filed on Dec. 9, 2015, with Application Number 201510903949.7, and TITLE "ELECTRONIC CIGARETTE BATTERY ASSEMBLY, ELECTRONIC CIGARETTE THEREWITH, AND CONTROL METHOD THEREOF", the disclosure of which is incorporated herein by reference.

FIELD

The subject matter relates to electronic cigarettes, and more particularly, to an electronic cigarette battery assembly, an electronic cigarette therewith, and a control method of the electronic cigarette.

BACKGROUND

Electronic cigarettes can be alternative to traditional cigarettes, supplying power to heating elements through a battery, so that electric heating elements heat a liquid to produce smoke, so that users get a smoking experience.

However, the electronic cigarette is generally operated by mechanical switches. For example, the electronic cigarette is turned on/off, operating modes are switched, output voltages/output powers/operating temperature are adjusted. However, the mechanical switches produce annoying "click" sounds. After long-term use, the mechanical switches are prone to failure. In addition, for the mechanical switch with a single function, it needs a number of mechanical switches to cooperate with each other to achieve a variety of functions, thus failing to improve the user experience.

BRIEF DESCRIPTION OF THE DRAWINGS

Implementations of the present technology will now be described, by way of example only, with reference to the attached figures.

DETAILED DESCRIPTION

The present disclosure, including the accompanying drawings, is illustrated by way of examples and not by way of limitation. In general, the word "module," as used hereinafter, refers to logic embodied in hardware or firmware, or to a collection of software instructions, written in a programming language, such as, for example, Java, C, or assembly. One or more software instructions in the modules may be embedded in firmware. It will be appreciated that modules may comprise connected logic units, such as gates and flip-flops, and may comprise programmable units, such as programmable gate arrays or processors. The modules described herein may be implemented as either software and/or hardware modules and may be stored in any type of non-transitory machine-readable storage medium or other computer storage device. The term "comprising," when utilized, means "including, but not necessarily limited to"; it specifically indicates open-ended inclusion or membership in the so-described combination, group, series, and the like.

Figure 1:
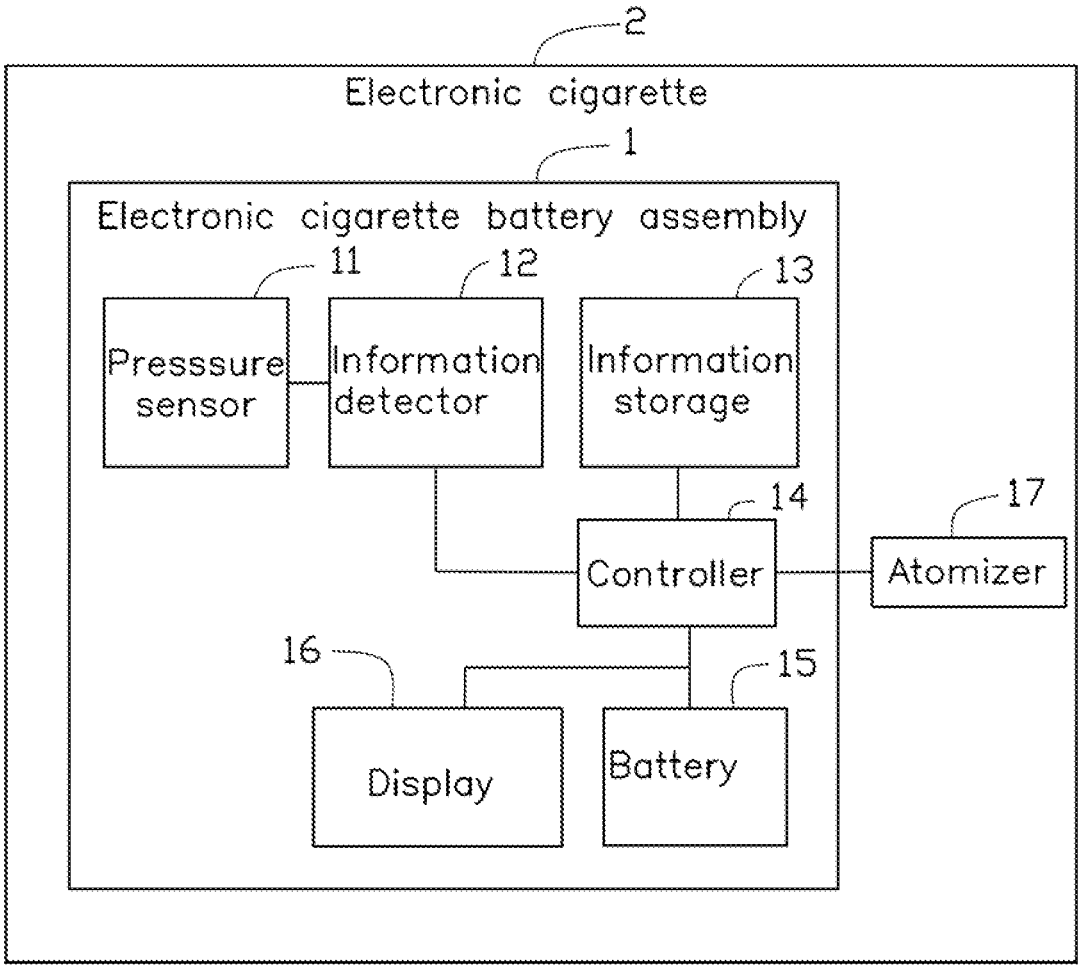
FIG. 1 is a block diagram of a first embodiment of an electronic cigarette with an electronic cigarette battery assembly.

FIG. 1 illustrates a first embodiment of an electronic cigarette 2. The electronic cigarette 2 includes an electronic cigarette battery assembly 1 and an atomizer 17. The electronic cigarette battery assembly 1 includes a pressure sensor 11, an information detector 12, an information storage 13, a controller 14, a display 16, and a battery 15. The pressure sensor 11 includes at least one pressure sensor 11, for sensing pressure information applied by a user to the electronic cigarette battery assembly 1 and converting the pressure information into sensed data. The information detector 12 is configured for detecting the sensed data. The information storage 13 is configured for storing preset values, corresponding to the sensed data. The preset values can be preset in advance, that is, before the electronic cigarette 2 starts operating. The preset values also can be set afterwards as needed. The controller 14 is configured for comparing the sensed data with the preset values and for controlling operating states of the atomizer 17 based on comparison results of sensed data and preset values. The battery 15 is configured for powering the pressure sensor 11, the information detector 12, the information storage 13, and the controller 14.

The controller 14 compares the sensed data with the preset values to control operating states of the atomizer 17 based on comparison results of sensed data and preset values. The operating state of the atomizer 17 includes a start operating state, a stop operating state, a switching operating mode state, an adjusting output voltage state, an adjusting output power state; an alarm state, an adjusting operating temperature state, and any combinations thereof.

Figure 2:
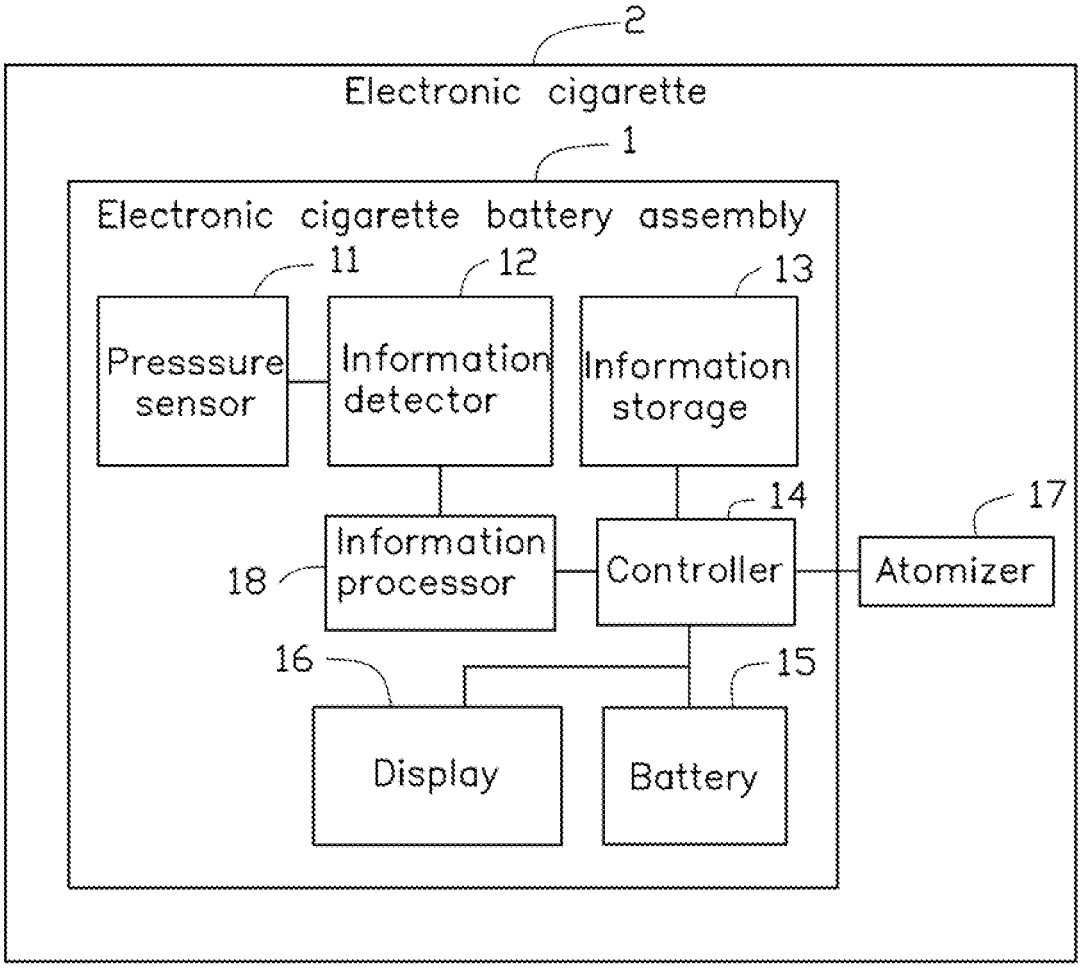
FIG. 2 is a block diagram of a second embodiment of an electronic cigarette with an electronic cigarette battery assembly.

FIG. 2 illustrates a second embodiment of an electronic cigarette 2. The electronic cigarette 2 includes an electronic cigarette battery assembly 1, and an atomizer 17. The second embodiment of the electronic cigarette battery assembly 1 is similar to the first embodiment of the electronic cigarette battery assembly 1, and further includes an information processor 18 connected between the information detection module 12 and the control module 14. The controller 14 is configured for comparing the sensed data with the preset values to control the operating states of the atomizer 17 based on comparison results of sensed data and preset values. The information processor 18 is configured for amplifying the sensed data and converting the sensed data to a machine-readable information, such as computer-readable information. In this way, even weak sensed data may be used to control the operating states of the atomizer 17. In other embodiments, the information processor 18 can be integrated with the controller 14, thus information processor 18 can be omitted.

The display 16 is connected to the controller 14 and the battery 15, for displaying the operating states of the atomizer 17, and operating parameters of the atomizer 17, and the like.

The atomizer 17 is electronically connected to the controller 14, for atomizing aerosol liquid to form an aerosol vapor for the user to inhale.

It should be noted that the above description is only exemplified by whether there is sensed data detected by information detector. In actual implementation, the step of comparing by the controller 14 can be preformed after the pressure sensor 11 generates the sensed data, the details are not repeated herein.

The pressure sensor 11 converts the pressure information into sensed data. The information detector 12 detects the sensed data. The controller 14 compares the sensed data with the preset values to control the operating states of the atomizer 17 based on comparison results of sensed data and preset values. The controller 14 controls the atomizer 17 to start operating, or stop operating, and the like. Thus, problems of click and switch failure due to using mechanical switches are also resolved and the electronic cigarette 2 achieves functions to improve the user's experience.

A control method of the electronic cigarette 2 is also disclosed. The control method includes: the pressure sensor 11 converting pressure information into sensed data; the information detector 12 detecting the sensed data; the controller 14 comparing the sensed data with preset values to control operating states of the atomizer 17 based on comparison results of sensed data and preset values.

The sensed data includes at least one of a sensed resistance of the pressure sensor 11, a sensed duration of the user applying pressure to the electronic cigarette 2, and a sensed number of times of the user applies pressure to the electronic cigarette 2 in some short period of time.

In another embodiment, the sensed data is a sensed resistance of the pressure sensor 11. The preset value is a preset resistance stored in the information storage 13 in advance. The information detector 12 detects the sensed resistance. The controller 14 compares the sensed resistance with the preset resistance. When the sensed resistance is less than the preset resistance, the controller 14 controls the atomizer 17 to enter a first operating state. When the sensed resistance is greater than or equal to the preset resistance, the controller 14 controls the atomizer 17 to enter a second operating state. In the embodiment, the operating states of atomizer 17 are on/off. The sensed resistance is Rs and the preset resistance is R. In the embodiment, the first operating state of the atomizer 17 is the stop operating state, and the second operating state of the atomizer 17 is the start operating state. Detailed control method refers to FIG. 3.

Figure 3:
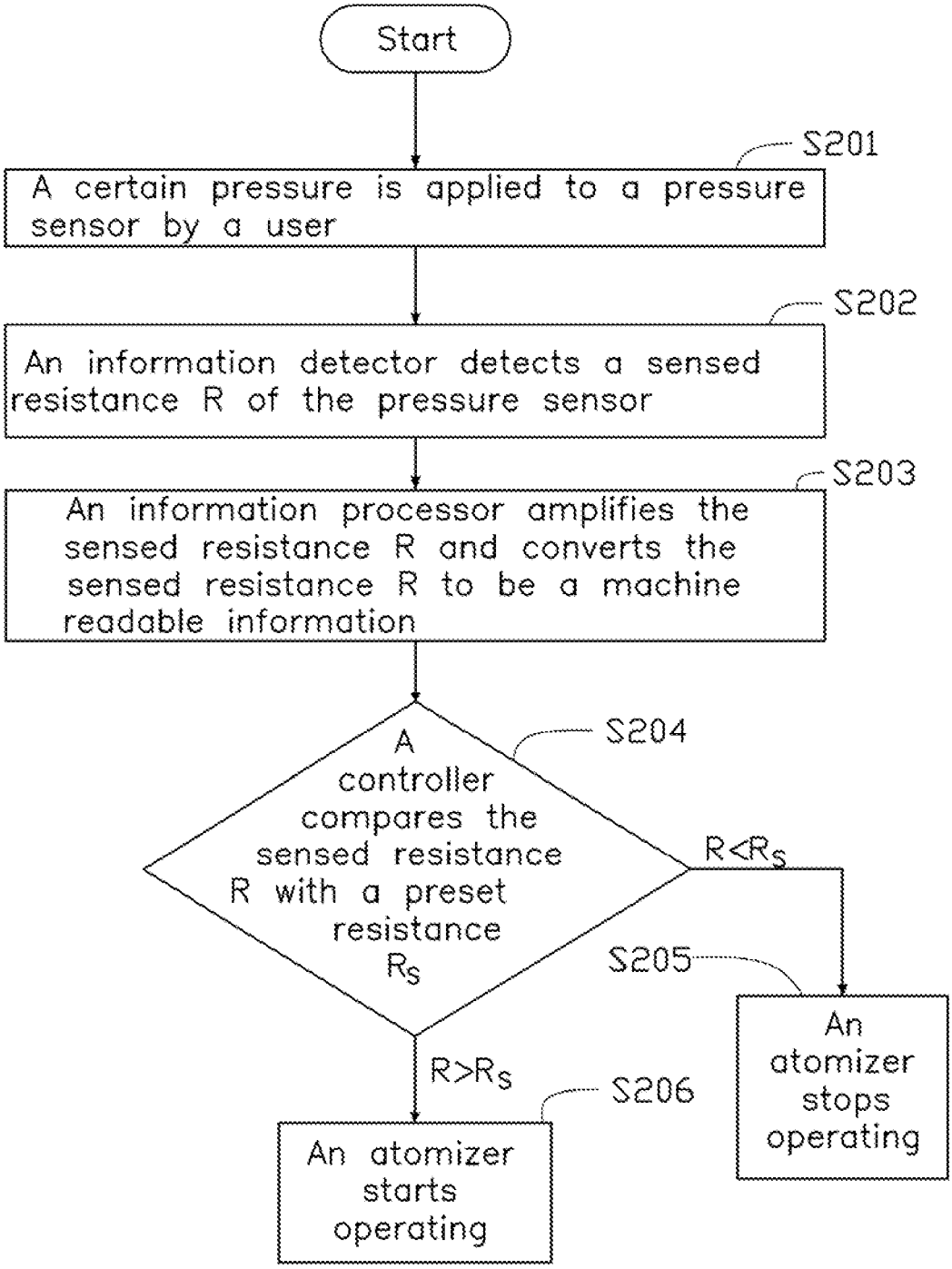
FIG. 3 is a flowchart of a first embodiment of a control method for an electronic cigarette.

FIG. 3 illustrates a first embodiment of a control method for an electronic cigarette.

At step 201, when a certain pressure is applied to the pressure sensor 11 by a user, the pressure sensor 11 generates sensed data based on the press operation. The sensed data includes a sensed resistance R.

At step 202, the information detector 12 detects the sensed data. When the information detector 12 detects the sensed resistance R, the procedure goes to step 203.

At step 203, the information processor 18 amplifies the sensed resistance R and converts the sensed resistance R to be a machine-readable information capable of being recognizable by the controller 14, then the procedure goes to step 204. Wherein the amplifying and converting method are well known arts, they are not further described herein.

At step 204, the controller 14 acquires the sensed resistance R from the information storage 13 and compares the sensed resistance R with the preset resistance Rs. When the sensed resistance R is less than the preset resistance Rs, the procedure goes to step 205. When the sensed resistance R is greater than or equal to the preset resistance Rs, the procedure goes to step 206.

At step 205, the atomizer 17 stops operating, that is, the atomizer 17 is turned off.

At step 206, the atomizer 17 starts operating. It may be also understood that the atomizer 17 is turned on.

In an embodiment, the electronic cigarette 2 still can work even the information processor 18 is omitted. In addition, the controller 14 compares the preset resistance value Rs with the sensed resistance R to control the atomizer 17 to enter the first operating state or the second operating state. The first operating state is the start operating state and the second operating state is the stop operating state.

In another embodiment, the information detector 12 detects a sensed resistance of the pressure sensor 11. The N preset values are prestored in the information storage 13, with N is an integer greater than 2, and the N preset values are different, the controller 14 determines an interval the N preset resistance located, and controls the atomizer enter a corresponding operating state according to the interval. For example, when N=4, the preset values include a second preset resistance, a third preset resistance, a fourth resistance, and a fifth resistance. The second preset resistance is less than the third resistance, the third resistance is less than the fourth resistance, and the fourth resistance is less than the fifth resistance. The controller 14 compares the sensed resistance with the second to fifth preset resistances. When the sensed resistance is less than or equal to the third preset resistance and greater than the second preset resistance, the controller 14 controls the atomizer 17 to enter a third operating state. When the sensed resistance is less than or equal to the fifth preset resistance and greater than the fourth preset resistance, the controller 14 controls the atomizer 17 to enter a fourth operating state. Otherwise, the atomizer 17 remains the current operating state, that is, when the sensed resistance is less than the second preset resistance or greater than the fifth preset resistance, the atomizer 17 remains the current operating state. In the embodiment, the controller 14 controls operating modes of the atomizer 17 to be switched after the atomizer 17 starts operating. The operating modes include a constant temperature mode, a constant voltage mode, a constant power mode, a temperature control mode, a voltage control mode, and a power control mode. The third operating state and the fourth operating state are two different operating modes. The current operating state is the current operating mode. In the embodiment, the sensed resistance is R, the second preset resistance is R2, the third preset resistance is R3, the fourth preset resistance is R4, and the fifth preset resistance is R5, wherein R2<R3<R4<R5. The third operating state is the voltage control mode, and the fourth operating state is the temperature control mode. Detailed control method refers to FIG. 4.

Figure 4:
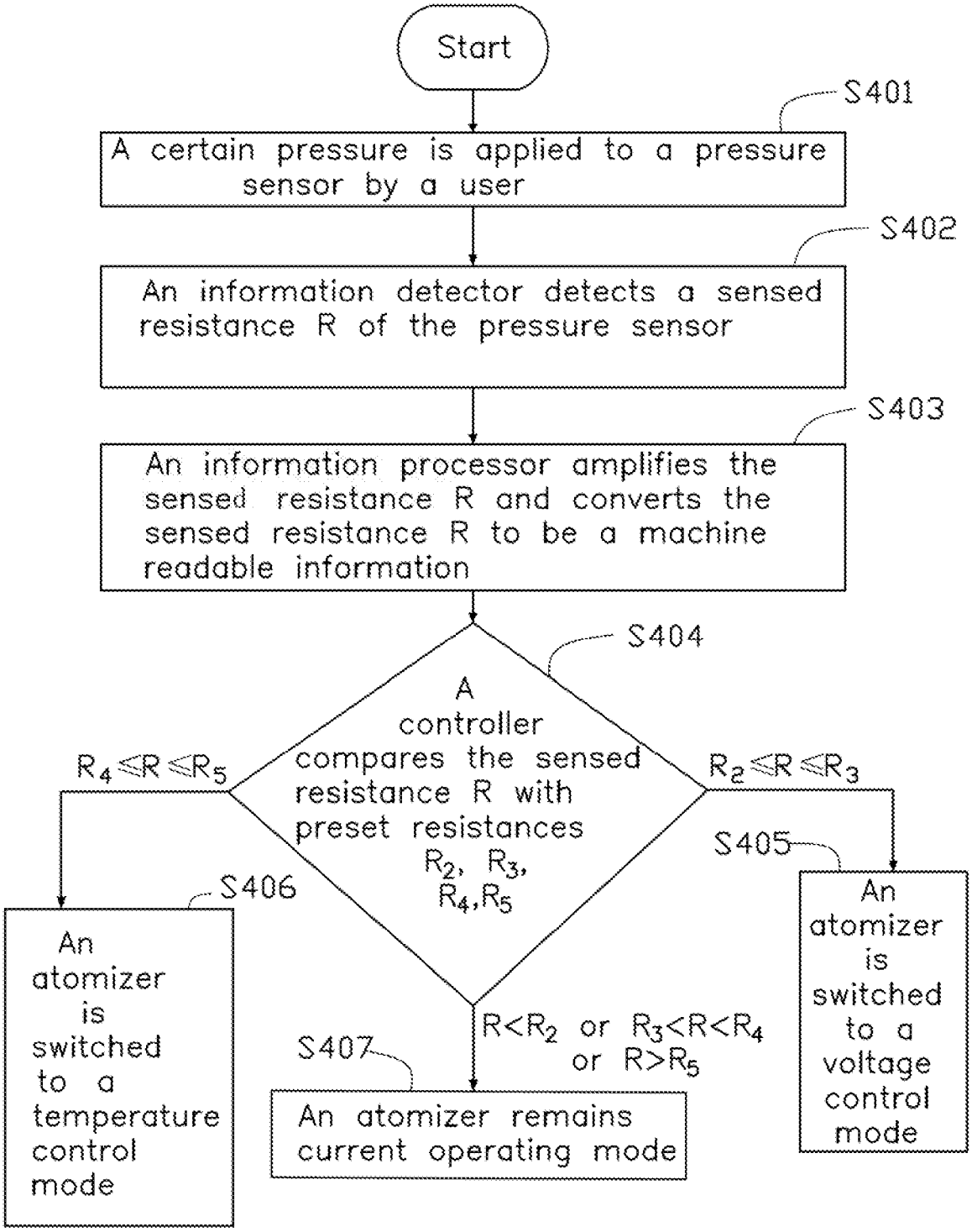
FIG. 4 is a flowchart of a second embodiment of a control method for an electronic cigarette.

FIG. 4 illustrates a second embodiment of a control method for an electronic cigarette.

At step 401, when a certain pressure is applied to the pressure sensor 11 by a user, the pressure sensor 11 generates a sensed data based on the press operation. The sensed data includes the sensed resistance R.

At step 402, the information detector 12 detects the sensed data. When the information detector 12 detects the sensed resistance R, the procedure goes to step 403.

At step 403, the information processor 18 amplifies the sensed resistance R and converts the sensed resistance R to be a machine-readable information capable of being recognizable by the controller 14, then the procedure goes to step 404. Wherein the amplifying and converting method are well known arts, they are not further described herein.

At step 404, the controller 14 acquires the second to fifth preset resistance R2 to R5 from the information storage 13 and compares the sensed resistance R with the preset resistances R2, R3, R4, and to R5. When the sensed resistance R is less than or equal to the preset resistance R3 and the sensed resistance R is greater than or equal to the preset resistance R2, the procedure goes to step 405. When the sensed resistance R is less than or equal to the preset resistance R5 and the sensed resistance R is greater than or equal to the preset resistance R4, the procedure goes to step 406. When the sensed resistance R is less than the preset resistance R2, or the sensed resistance R is greater than the preset resistance R3 and greater than the preset resistance R4, or the sensed resistance R is greater than the preset resistance R5, the procedure goes to step 407.

At step 405, the operating state of the atomizer 17 is switched to the voltage control mode by the controller 14.

At step 406, the operating state of the atomizer 17 is switched to the temperature control mode.

At step 407, the operating state of the atomizer 17 remains the current operating mode.

It is to be understood that the embodiment of the electronic cigarette 2 still can work even the information processor 18 is omitted. In addition, the controller 14 compares the preset resistance values R2, R3, R4, R5 with the sensed resistance R to control the operating states of the atomizer 17 to enter the third operating state, or the fourth operating state, or remain current operating mode. The third operating state is the voltage control mode, the fourth operating mode is the temperature control mode.

In another embodiment, the sensed data includes a sensed resistance and a sensed duration of the user applying pressure. A group of preset values of the sensed data are stored in the information storage 13 in advance and includes a preset resistance, and a preset duration. The information detector 12 detects the sensed resistance and the sensed duration. The controller 14 compares the sensed resistance with the preset resistance and compares the preset duration with the sensed duration. When the sensed resistance is less than or equal to the preset resistance and the sensed duration is greater than or equal to the preset duration, the controller 14 controls the atomizer 17 to enter a second operating state, otherwise, the controller 14 controls the atomizer 17 to enter first operating state. In the embodiment, the controller 14 controls the atomizer 17 to be turned on/off. The preset resistance is Rs, the preset duration is Ts. The sensed resistance is R, the sensed duration is T. The first operating state is the atomizer 17 being turned off, and the second operating state is the atomizer 17 being turned on. Detailed control method refers to FIG. 5.

Figure 5:
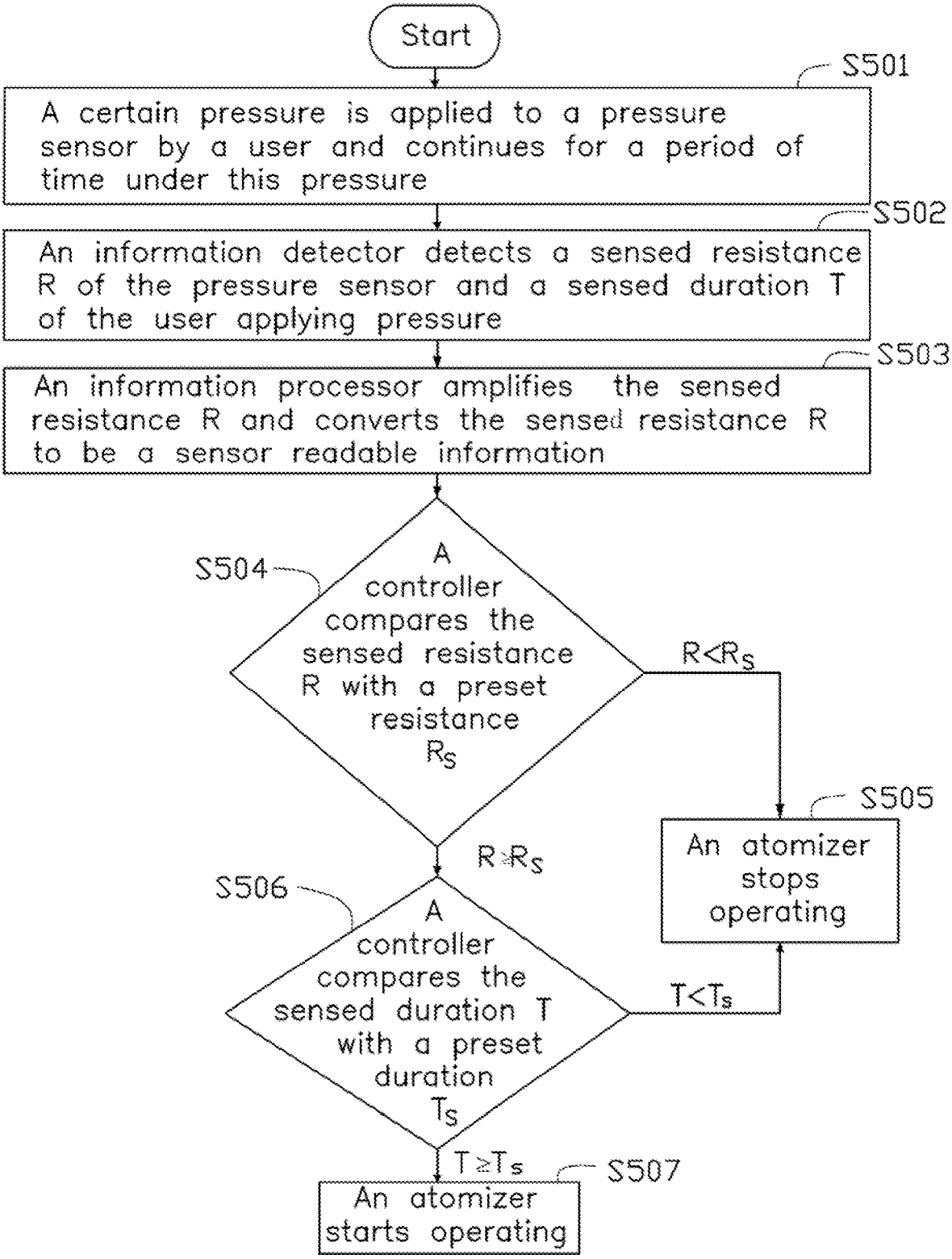
FIG. 5 is a flowchart of a third embodiment of a control method for an electronic cigarette.

FIG. 5 illustrates a third embodiment of a control method for an electronic cigarette.

At step 501, when a certain pressure is applied to the pressure sensed module 11 by a user and continues for a period of time under this pressure, the pressure sensor 11 generates sensed data based on the press operation. The sensed data includes a sensed resistance R and a sensed duration T of the user applying pressure.

At step 502, the information detector 12 detects the sensed data. When the information detector 12 acquires the sensed resistance R and the sensed duration of the user applying pressure, the procedure goes to step 503.

At step 503, the information processor 18 amplifies the sensed resistance R, and converts the sensed resistance R and the sensed duration T to be machine-readable information recognized by the controller 14. The information processor 18 acquires the sensed resistance R and the sensed duration T; then the procedure goes to step 504. Wherein the amplifying and converting method are well known arts, they are not further described herein.

At step 504, the controller 14 acquires the preset resistance Rs from the information storage 13 and compares the sensed resistance R with the preset resistance Rs. When the sensed resistance R is less than the preset resistance Rs, the procedure goes to step 505. When the sensed resistance R is greater than or equal to the preset resistance Rs, the procedure goes step 506.

At step 505, the controller 14 controls the atomizer 17 to stop operating, that is, the atomizer 17 enters the first operating state.

At step 506, the controller 14 acquires the sensed duration from the information storage 13 and compares the sensed duration T with the preset duration Ts. When $T<Ts$, the procedure goes to step 505. When $T\geq Ts$, the procedure goes to step 507.

At step 507, the controller 14 controls the atomizer 17 to start operating, that is, the atomizer 17 enters the second operating state.

In the embodiment, the controller 14 controls the atomizer 17 to start operating simultaneously only when satisfying two conditions, which is considered beyond a child's intellectual restrictions. Thus, the electronic cigarette 2 has a child proof function.

It is to be understood that the embodiment of the electronic cigarette 2 still can work even the information processor 18 is omitted. In addition, the controller 14 compares the preset resistance Rs with the sensed resistance R, and compares the preset duration Ts with the sensed duration T to controls the operating states of the atomizer 17 to enter the first operating state or the second operating state. The first operating state is the start operating state and the second operating state is the stop operating state.

In another embodiment, the preset values include a sixth preset resistance and a seventh resistance, wherein the sixth preset resistance is less than the seventh resistance. The information detector 12 detects a sensed resistance of the pressure sensor 11. The controller 14 compares the sensed resistance with the sixth and the seventh preset resistances. When the sensed resistance is less than or equal to the sixth preset resistance and greater than zero, the controller 14 controls the atomizer 17 to enter a fifth operating state. When the sensed resistance is less than or equal to the seventh preset resistance and greater than the sixth preset resistance, the controller 14 controls the atomizer 17 to enter a sixth operating state. When the sensed resistance is greater than the seventh preset resistance, the controller 14 controls the atomizer 17 to enter a seventh operating state. In the embodiment, the controller 14 controls operating parameters of the atomizer 17 after the operating mode of the atomizer 17 being switched. The fifth and the sixth operating modes are two operating parameters of the atomizer 17. The seventh operating state is alarm is given, when the operating setting parameters exceeded an allowable range. The operating parameters correspond to the operating modes, for example, the operating parameter of the atomizer 17 is the operating temperature of the atomizer 17 when the operating mode of the atomizer 17 is switched to the temperature control mode. In the embodiment, the sensed resistance is R, the sixth preset resistance is RL, the seventh resistance is RH, wherein $RL<RH$. The fifth operating state is the atomizer 17 with a lower output power, the sixth operating state is the atomizer 17 operating with a higher output power, and the seventh operating state is an alarm state. Detailed control method refers to FIG. 6.

Figure 6:
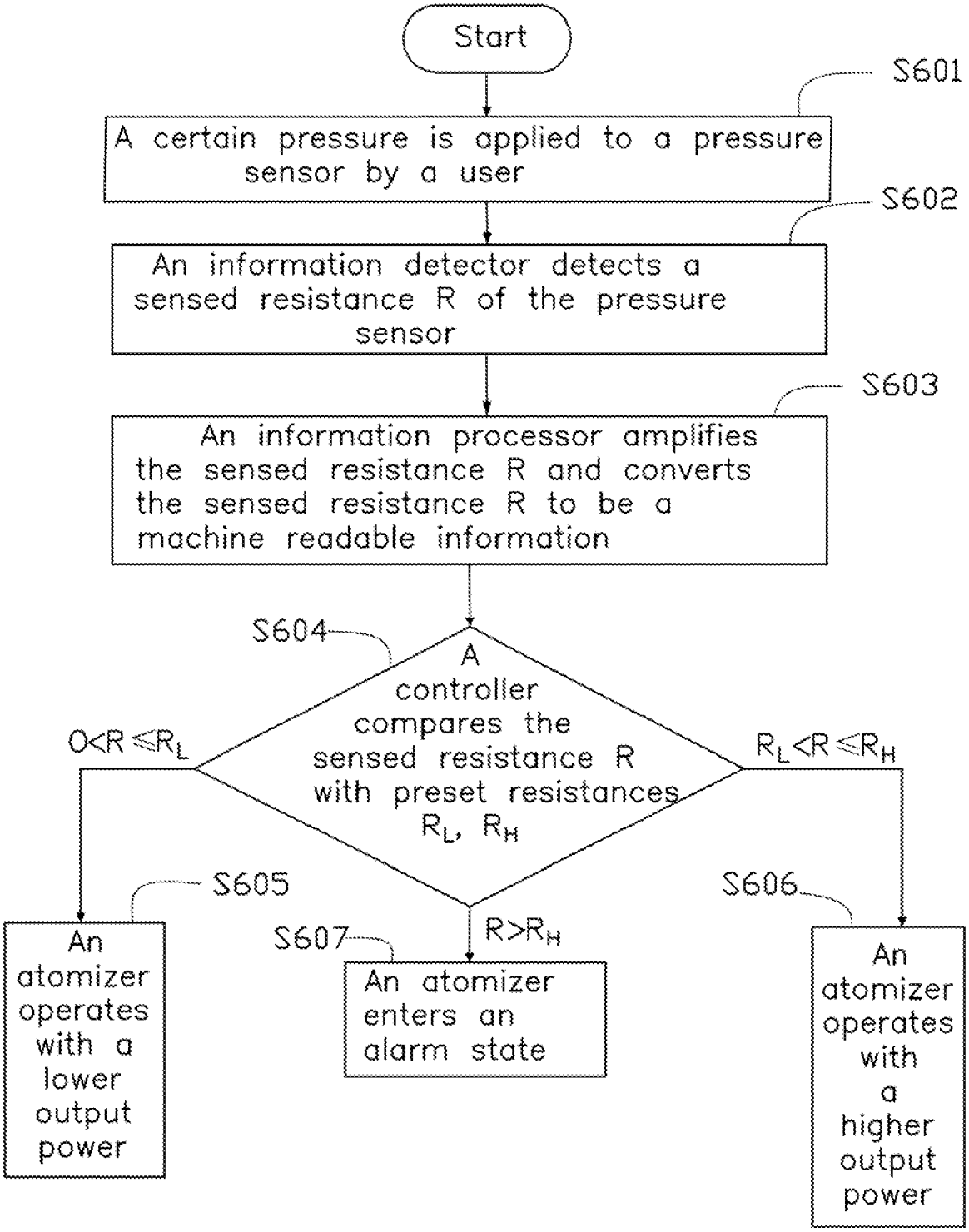
FIG. 6 is a flowchart of a fourth embodiment of a control method for an electronic cigarette.

FIG. 6 illustrates a fourth embodiment of a control method for an electronic cigarette.

At step 601, when a certain pressure is applied to the pressure sensor 11 by a user, the pressure sensor 11 generates a sensed data based on the press operation. The sensed data comprises the sensed resistance.

At step 602, the information detector 12 detects sensed data. When the sensed resistance R is detected, the procedure goes to step 603.

At step 603, the information processor 18 amplifies the sensed resistance R and converts the sensed resistance R to be a machine-readable information recognizable by the controller 14. The information processor 18 obtains the sensed resistance R; then the procedure goes to step 604. Wherein the amplifying and converting method are well known arts, they are not further described herein.

At step 604, the controller 14 acquires the sensed resistance R from the information storage 13 and compares the sensed resistance R with preset resistances RL, RH. When the sensed resistance R is less than or equal to the preset resistance RL and the sensed resistance R is greater than zero, the procedure goes to step 605. When the sensed resistance R is less than or equal to the preset resistance RH and the sensed resistance R is greater than preset resistance RL, the procedure goes to step 606. When the sensed resistance R is greater than the preset resistance RH, the procedure goes to step 607.

At step 605, the controller 14 controls the atomizer 17 to operate with a lower output power, that is, the atomizer 17 enters the fifth operating state.

At step 606, the controller 14 controls the atomizer 17 to operate with a higher output power, that is, the atomizer 17 enters the sixth operating state.

At step 607, the controller 14 controls the display 16 gives the alarm, the atomizer 17 enters the seventh operating state.

It is to be understood that the embodiment of the electronic cigarette 2 still can work even the information processor 18 is omitted. The controller 14 compares the preset resistances RL, RH with the sensed resistance R to control the operating states of the atomizer 17 to enter the fifth operating state or the sixth operating state, or the seventh operating state. The first operating state is the start operating state and the second operating state is the stop operating state. The fifth operating state is the atomizer 17 operating with a lower output power, the sixth operating state is the atomizer 17 operating with a higher output power, and the seventh operating state is the alarm state.

It is to be understood, even though information and advantages of the present embodiments have been set forth in the foregoing description, together with details of the structures and functions of the present embodiments, the disclosure is illustrative only; changes may be made in detail, especially in matters of shape, size, and arrangement of parts within the principles of the present embodiments to the full extent indicated by the plain meaning of the terms in which the appended claims are expressed.

What is claimed is:

1. An electronic cigarette battery assembly comprising:

a pressure sensor configured for converting pressure information when a pressure applied to the electronic cigarette by a user into sensed data;

an information storage configured for storing one or more preset values; and a controller configured for comparing the sensed data with the preset values and configured for controlling operating states of an atomizer based on comparison results of the sensed data and the preset values;

wherein the sensed data is the sensed resistance of the pressure sensor, the information storage stores at least one preset value, the at least one preset value is a preset resistance.

2. The electronic cigarette battery assembly of claim 1, wherein the at least one preset value comprises a preset resistance and a preset duration.

3. The electronic cigarette battery assembly of claim 1, wherein information storage configured for storing one preset value, the preset value is a first preset resistance, the controller compares the sensed resistance with the first preset resistance, and:

when the sensed resistance is less than the first preset resistance, the controller controls the atomizer to enter a first operating state; and when the sensed resistance is greater than or equal to the first preset resistance, the controller controls the atomizer to enter a second operating state.

4. The electronic cigarette battery assembly of claim 1, wherein the information storage stores N preset values, N is an integer greater than 2, the preset values comprises a second preset resistance, a third preset resistance, and a N+1 preset resistance, according to an interval the N preset resistance located, the atomizer is controlled to enter the corresponding operating state according to the interval.

5. The electronic cigarette battery assembly of claim 1, wherein the information storage stores two preset values, the preset values comprises a sixth preset resistance and a seventh preset resistance, the sixth preset resistance is less than the seventh preset resistance, the controller compares the sensed resistance with the sixth and the seventh preset resistances, and when the sensed resistance is less than or equal to the sixth preset resistance and greater than zero, the controller controls the atomizer to enter a fifth operating state;

when the sensed resistance is less than or equal to the seventh preset resistance and greater than the sixth preset resistance, the controller controls the atomizer to enter a sixth operating state;

when the sensed resistance is greater than the seventh preset resistance, the controller controls the atomizer to enter a seventh operating state.

6. The electronic cigarette battery assembly of claim 2, wherein the information storage stores a group of preset values, the preset values are a first preset resistance and a preset duration, the controller compares the sensed resistance with the first preset resistance, and compares the preset duration with the sensed duration, and when the sensed resistance is greater than or equal to the first preset resistance and the sensed duration is greater than or equal to the preset duration, the controller controls the atomizer to enter a second operating state;

when the sensed resistance is less than the first preset resistance and the sensed duration is less than the preset duration, the controller controls the atomizer to enter a first operating state.

7. The electronic cigarette battery assembly of claim 1, wherein the controller is configured for amplifying and converting the sensed data into a machine-readable information, and configured for comparing the machine-readable information with the preset values, and the atomizer is controlled to enter a corresponding operating state according to the comparison result.

8. The electronic cigarette battery assembly of claim 1, wherein based on the comparison results of the sensed data and the preset values, the atomizer is controlled into an operating state comprising one or more of a start operating state, a stop operating state, a switching operating mode state, an adjusting output voltage state, an adjusting output power state; an alarm state, and an adjusting operating temperature state and any combination thereof.

9. An electronic cigarette comprising: an atomizer; and an electronic cigarette battery assembly of claim 1.

10. A control method for an electronic cigarette, wherein the control method comprising:

receiving pressure information when a pressure applied by a user and converting the pressure information into sensed data;

storing preset values in information storage; and comparing the sensed data with the preset values to control operating states of the atomizer based on comparison results of sensed data and preset values;

wherein the sensed data is a sensed resistance of the pressure sensor, the information storage stores at least one preset value, the at least one preset value is a preset resistance.

11. The controlling method of claim 10, wherein the at least one preset value comprises a preset resistance and a preset duration.

12. The controlling method of claim 10, wherein the information storage configured for storing one preset value, the preset value is a first preset resistance, the controller compares the sensed resistance with the first preset resistance, the atomizer is controlled to enter a corresponding operating state according to the comparison result, comprising:

when the sensed resistance is less than the first preset resistance, the controller controls the atomizer to enter a first operating state;

when the sensed resistance is greater than or equal to the first preset resistance, the controller controls the atomizer to enter a second operating state.

13. The control method of claim 10, wherein the information storage stores N preset values, with N is an integer greater than 2, the preset values comprises a second preset resistance, a third preset resistance, and a N+1 preset resistance, the sensed resistance is compared with the N preset resistances, the atomizer is controlled to enter a corresponding operating state according to the comparison result, comprising: according to an interval the N preset resistance located, the atomizer is controlled to enter the corresponding operating state according to the interval.

14. The control method of claim 10, wherein the information storage stores two preset values, the preset values comprises a sixth preset resistance and a seventh preset resistance, the sixth preset resistance is less than the seventh preset resistance, the sensed data is compared with the preset values, the atomizer is controlled to enter a corresponding operating state according to the comparison result, comprising:

when the sensed resistance is less than or equal to the sixth preset resistance and greater than zero, the controller controls the atomizer to enter a fifth operating state;

when the sensed resistance is less than or equal to the seventh preset resistance and greater than the sixth preset resistance, the controller controls the atomizer to enter a sixth operating state;

when the sensed resistance is greater than the seventh preset resistance, the controller controls the atomizer to enter a seventh operating state.

15. The control method of claim 11, wherein the information storage stores a group of preset values, the preset values are a first preset resistance and a preset duration, the sensed data is compared with the preset values, the atomizer is controlled to enter a corresponding operating state according to the comparison result, comprising: when the sensed resistance is greater than or equal to the first preset resistance, the controller and compares the preset duration with the sensed duration;

when the sensed resistance is less than the first preset resistance, the controller controls the atomizer to enter a first operating state.

16. The control method of claim 15, wherein the comparing the preset duration with the sensed duration, and controlling the atomizer entering the operating state further comprise:

when the sensed duration is greater than or equal to the preset duration, the atomizer is controlled to enter a second operating state;

when the sensed duration is less than the preset duration, the atomizer is controlled to enter the first operating state.

17. The control method of claim 10, wherein the method further comprises: amplifying and converting the sensed data to a machine-readable information, and comparing the machine-readable information with the preset values, and the atomizer is controlled to enter a corresponding operating state according to the comparison result.

18. The control method of claim 10, wherein based on the comparison results of the sensed data and the preset values, the atomizer is controlled into an operating state comprising one or more of a start operating state, a stop operating state, a switching operating mode state, an adjusting output voltage state, an adjusting output power state; an alarm state, and an adjusting operating temperature state, and any combination thereof.

* * * * *